US012338091B2

(12) United States Patent
Hunt et al.

(10) Patent No.: US 12,338,091 B2
(45) Date of Patent: Jun. 24, 2025

(54) SYSTEM FOR REDUCING ROLLED STOCK WASTE

(71) Applicant: NIAGARA BOTTLING, LLC, Diamond Bar, CA (US)

(72) Inventors: Jayson P. Hunt, Minneola, FL (US); Colin J. Pastore, Diamond Bar, CA (US); Daren A. Ruben, Diamond Bar, CA (US); Jesus A. Pizarro Cruz, Diamond Bar, CA (US); Darren P. Robinson, Diamond Bar, CA (US)

(73) Assignee: Niagara Bottling, LLC, Diamond Bar, CA (US)

( * ) Notice: Subject to any disclaimer, the term of this patent is extended or adjusted under 35 U.S.C. 154(b) by 145 days.

(21) Appl. No.: 18/334,982

(22) Filed: Jun. 14, 2023

(65) Prior Publication Data

US 2023/0405656 A1 Dec. 21, 2023

Related U.S. Application Data

(60) Provisional application No. 63/352,126, filed on Jun. 14, 2022.

(51) Int. Cl.
*B65H 19/18* (2006.01)
*B65H 26/06* (2006.01)

(52) U.S. Cl.
CPC ..... *B65H 26/063* (2013.01); *B65H 19/18* (2013.01); *B65H 2553/414* (2013.01)

(58) Field of Classification Search
CPC ... B65H 19/18; B65H 19/1873; B65H 26/063
See application file for complete search history.

(56) References Cited

U.S. PATENT DOCUMENTS

| | | | |
|---|---|---|---|
| 3,201,057 | A | 8/1965 | Danahey |
| 3,467,334 | A | 9/1969 | Chesnut et al. |
| 3,516,617 | A | 6/1970 | Haner et al. |
| 3,863,855 | A | 2/1975 | Gaubert |
| 3,873,393 | A | 3/1975 | Bruck et al. |

(Continued)

FOREIGN PATENT DOCUMENTS

| | | | |
|---|---|---|---|
| EP | 0614809 | A2 | 9/1994 |
| EP | 1950137 | A1 | 7/2008 |

(Continued)

OTHER PUBLICATIONS

International Search Report and Written Opinion for Application No. PCT/US2023/068451 dated Oct. 16, 2023 (15 pages).

(Continued)

*Primary Examiner* — Sang K Kim
(74) *Attorney, Agent, or Firm* — Michael Best & Friedrich LLP

(57) ABSTRACT

A sensor assembly configured to detect rolled stock on a core includes a sensor configured to detect a first roll of stock unwinding from a core, the stock unwinding from the core of the first roll is supplied as a web of stock, wherein in response to the sensor detecting a first detection configuration, the sensor takes no action and continues to detect the first roll, and wherein in response to the sensor detecting a second detection configuration, the sensor provides a command to a splice assembly to transition to a second roll of stock to replace the first roll of stock.

18 Claims, 8 Drawing Sheets

(56) References Cited

U.S. PATENT DOCUMENTS

| | | | | |
|---|---|---|---|---|
| 3,886,031 | A | 5/1975 | Taitel | |
| 3,907,235 | A | 9/1975 | Gaubert | |
| 3,915,399 | A | 10/1975 | Kron et al. | |
| 3,974,490 | A | 8/1976 | Mori | |
| 4,009,065 | A | 2/1977 | Mikulas | |
| 4,021,002 | A * | 5/1977 | Meihofer | B65H 19/18 242/563.2 |
| 4,024,782 | A | 5/1977 | Kron et al. | |
| 4,264,401 | A | 4/1981 | Ganz | |
| RE30,868 | E | 2/1982 | Mori | |
| 4,417,940 | A | 11/1983 | Koster | |
| 4,628,499 | A | 12/1986 | Hammett | |
| 4,772,350 | A | 9/1988 | Gamberini | |
| 5,039,374 | A | 8/1991 | Winter | |
| 5,045,134 | A | 9/1991 | Schenker et al. | |
| 5,152,858 | A | 10/1992 | Winter | |
| 5,231,439 | A | 7/1993 | Takahashi et al. | |
| 5,292,397 | A | 3/1994 | Lorenz et al. | |
| 5,297,751 | A | 3/1994 | Boldrini et al. | |
| 5,671,895 | A | 9/1997 | Cederholm et al. | |
| 5,899,406 | A | 5/1999 | Payne | |
| 5,902,431 | A | 5/1999 | Wilkinson et al. | |
| 6,051,095 | A * | 4/2000 | Butterworth | B65H 19/1873 156/286 |
| 6,792,987 | B2 | 9/2004 | Monroe | |
| 6,923,880 | B2 * | 8/2005 | Keene | B65H 23/1886 156/159 |
| 8,088,238 | B2 | 1/2012 | Hafner | |
| 8,360,124 | B2 | 1/2013 | Carson et al. | |
| 9,056,400 | B2 | 6/2015 | Carson et al. | |
| 9,914,279 | B2 | 3/2018 | Van Der Kaap | |
| 10,301,134 | B2 | 5/2019 | Gnan | |
| 11,225,390 | B2 | 1/2022 | Monzoni et al. | |
| 2008/0135158 | A1 | 6/2008 | Baumli | |
| 2012/0074255 | A1 | 3/2012 | Baumli | |
| 2015/0290919 | A1 | 10/2015 | Carson et al. | |
| 2016/0114501 | A1 | 4/2016 | Carson et al. | |
| 2016/0318321 | A1 | 11/2016 | Takahashi et al. | |
| 2017/0313461 | A1 | 11/2017 | Saccardi et al. | |
| 2018/0162668 | A1 | 6/2018 | Hong | |
| 2021/0087009 | A1 | 3/2021 | Nelson et al. | |
| 2022/0396451 | A1 | 12/2022 | Lalonde et al. | |

FOREIGN PATENT DOCUMENTS

| | | | |
|---|---|---|---|
| EP | 2233399 | A1 | 9/2010 |
| WO | 199513235 | A1 | 5/1995 |
| WO | 199732803 | A1 | 9/1997 |
| WO | 2005110902 | A1 | 11/2005 |
| WO | 2007009585 | A1 | 1/2007 |
| WO | 2014117091 | A1 | 7/2014 |
| WO | 2018211118 | A1 | 11/2018 |
| WO | 2023046416 | A1 | 3/2023 |

OTHER PUBLICATIONS

International Search Report and Written Opinion for Application No. PCT/US2024/043477 dated Nov. 26, 2024 (11 pages).

* cited by examiner

SYSTEM FOR REDUCING ROLLED STOCK WASTE

CROSS-REFERENCE TO RELATED APPLICATIONS

This application claims priority to U.S. Provisional Patent Application No. 63/352,126, which was filed on Jun. 14, 2022 and entitled "System For Reducing Rolled Stock Waste," the entire contents of which is hereby incorporated by reference in its entirety.

FIELD OF THE DISCLOSURE

The present disclosure relates to a system for reducing waste of rolled stock. More specifically, the present disclosure relates to a system to reduce waste of rolled stock on a core by actively detecting a quantity of rolled stock on the core during unwinding and transitioning to a new roll in response to the detected quantity.

BACKGROUND

Rolled stock is generally known in the art. Rolled stock includes a medium wound onto a core in a roll format for shipping, storage, and/or use. In some use applications, the medium is unwound from the core. In some other applications, the medium is unwound from the core at high speed. In these high speed unwind applications, the unwind system can include at least two rolls of wound medium. One roll is actively being unwound. When the actively unwound roll reaches a predetermined roll diameter that indicates the medium is about to run out, the unwind system can splice in the other roll to facilitate a continuous unwinding of the medium. However, there are certain limitations in known systems that lead to significant amounts of medium waste on the roll core.

As one example, known systems can include an ultraviolet (UV) sensor that is configured to detect a marking that is physically placed on the medium by the rolled stock manufacturer. The marking is applied while the rolled stock is being wound onto the core. The physically placed marking is provided as an indicator of a "low" roll diameter. However, placement of the marking occurs at variable locations along the wound medium. The marking is not uniformly positioned at a standard position with a specific quantity of linear feet of stock on the core. Instead, the marking is positioned randomly with differing amounts of wound medium remaining on the roll (or with different lengths of linear feet of medium remaining on the core). Thus, the positioning of the marking is variable between rolls of wound medium, as the wound medium manufacturer has to place the marking. Different rolls can have the marking positioned at different positions along the length of the medium wound on the roll.

Further, manufacturers of rolled stock are not incentivized to minimize the amount of medium wound on the core. Manufacturers are instead incentivized to position the marker with a "safe" amount (or quantity) of medium wound on the core to avoid the roll running out of medium before spicing to the next roll. Stated another way, a manufacturer does not want a roll to "fail" by positioning the marking on the medium with a small amount (or length) of medium to the core (i.e., the marking is positioned in relatively close proximity to the core). If all of the medium on the core is used before the splice to the next roll, the next roll has to be manually spliced. Manual splicing of a roll is both labor and time intensive, and results in unwanted system downtime. This "safe" amount of medium wound on the core is unusable waste.

Accordingly, a substantial amount of rolled medium generally remains on the core after the splice to a new roll. This medium remaining on the core is not usable after the splice, and is waste. This waste on the core (or waste rolled medium) can be up to 3% of the total medium wound onto the core. Accordingly, what is needed is a system to reliably detect a quantity of medium on an unwinding roll to reduce medium waste on the core before initiating a splice to a new roll. In addition, a system is needed that eliminates variability from outside sources or third parties, such as manufacturers of rolled medium, that leads to medium waste.

SUMMARY

In one example of an embodiment, a sensor assembly configured to detect rolled stock on a core includes a sensor configured to detect a first roll of stock unwinding from a core, the stock unwinding from the core of the first roll is supplied as a web of stock, wherein in response to the sensor detecting a first detection configuration, the sensor takes no action and continues to detect the first roll, and wherein in response to the sensor detecting a second detection configuration, the sensor provides a command to a splice assembly to transition to a second roll of stock to replace the first roll of stock.

In another example of an embodiment of the sensor assembly, the sensor is configured to communicate with a manual splice actuation system.

In another example of an embodiment of the sensor assembly, the manual splice actuation system is configured to initiate a splice in response to the command from the sensor to transition from the first roll to the second roll to provide a continuous web of stock.

In another example of an embodiment of the sensor assembly, the sensor is configured to communicate with the manual splice actuation system to bypass an automatic splice actuation system.

In another example of an embodiment of the sensor assembly, the first detection configuration includes detecting the stock on the core.

In another example of an embodiment of the sensor assembly, the second detection configuration includes detecting the core.

In another example of an embodiment of the sensor assembly, the core defines an axis of rotation, the sensor is oriented relative to the first roll perpendicular to the axis of rotation.

In another example of an embodiment of the sensor assembly, the first detection configuration includes detecting a first quantity of stock on the core, the first quantity of stock is above a preprogrammed low level threshold.

In another example of an embodiment of the sensor assembly, the second detection configuration includes detecting a second quantity of stock on the core, the second quantity of stock does not exceed the preprogrammed low level threshold.

In another example of an embodiment of the sensor assembly, the core defines an axis of rotation, the sensor is oriented relative to the first roll parallel to the axis of rotation.

In another example of an embodiment of the sensor assembly, the sensor is configured to detect a portion of the first roll of stock including the core.

In another example of an embodiment of the sensor assembly, the sensor utilizes machine vision to detect the first and second quantity of stock on the core.

In another example of an embodiment of the sensor assembly, the machine vision captures volumetric data of the stock on the core.

In another example of an embodiment of the sensor assembly, the machine vision captures geometric data of the stock on the core.

In another example of an embodiment of the sensor assembly, the preprogrammed low level threshold corresponds to no more than five impressions of rolled stock remain on the core.

In another example of an embodiment of the sensor assembly, the preprogrammed low level threshold corresponds to no more than three impressions of rolled stock remain on the core.

In another example of an embodiment of the sensor assembly, the sensor includes a light source configured to illuminate a portion of the first roll.

In another example of an embodiment of the sensor assembly, in response to the transition to the second roll of stock, no more than five impressions of rolled stock remain on the core.

In another example of an embodiment of the sensor assembly, in response to the transition to the second roll of stock, no more than three impressions of rolled stock remain on the core.

In another example of an embodiment of the sensor assembly, in response to the transition to the second roll of stock, between 1.5 and 2 impressions of rolled stock remain on the core.

Figure 1:
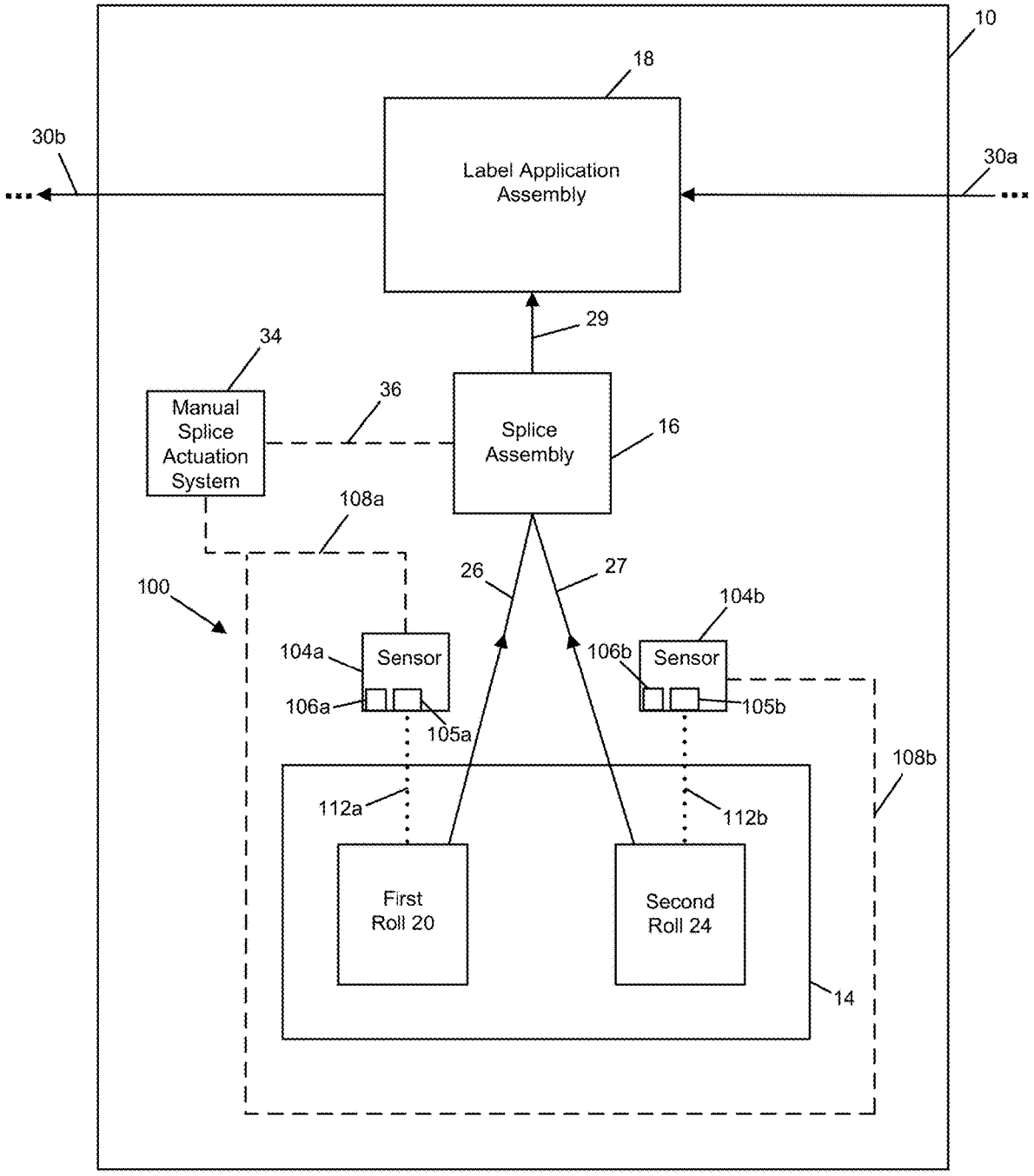
FIG. 1 is a schematic diagram of an example of a labeling assembly utilizing rolled stock from a plurality of rolls that integrates an embodiment of a detection assembly.

Before embodiments of the disclosure are explained in detail, it is to be understood that the disclosure is not limited in its application to the details of construction and the arrangement of components set forth in the following description or illustrated in the accompanying drawings. The disclosure is capable of supporting other embodiments and of being practiced or of being carried out in various ways.

DETAILED DESCRIPTION

The present disclosure is directed to a detection assembly 100, 300 and associated detection and control system 200, 400. The assembly and system are configured to be retrofit to an assembly utilizing rolled stock, such as a labeling assembly 10 for a container 30, or a packaging system 50 for a plurality of containers 30 (such as a stretch wrapping system, a shrink wrapping system, etc.). The assembly 100, 300 and system 200, 400 are configured to reduce waste of the rolled stock remaining on a core by initiating a splice in response to detection of a predetermined quantity of rolled stock remaining on the core. This maximizes use of the rolled stock by reducing the regularity of "early" splices between rolls of rolled stock during a continuous roll unwinding process.

It should be appreciated that a "roll of wound medium" or "rolled stock" or "reel-fed stock" can be a roll form of any suitable medium (or stock) wound onto a core. The roll can be any suitable or desired roll width, roll diameter, and/or core diameter. In addition, wound medium (or stock) can be any suitable medium. In one example of an embodiment disclosed herein, the wound medium includes labels for attachments to a container, such as a polyethylene terephthalate (PET) bottle. In another example of an embodiment disclosed herein, the wound medium includes a packaging material for wrapping a plurality of containers, such as a shrink wrap plastic material, a stretch wrap plastic material, or any other suitable packaging film. In yet other examples of embodiments, the wound medium can include any other material that is wound onto the core in roll form and that is unwound for use, and the unwinding of the wound medium is generally occurring in a continuous unwinding process where consecutive rolls of wound medium are spliced together.

With reference now to the figures, FIG. 1 is a schematic diagram of an example of an embodiment of an assembly 10 utilizing rolled stock. The assembly 10 incorporates a detection system 100 configured to reduce rolled stock waste. The illustrated assembly is a labeling assembly 10. The labeling assembly 10 is configured to apply a label to a container. The container can be a bottle, such as a blow molded polyethylene terephthalate (PET) plastic bottle. However, in other embodiments, the container can be any suitable vessel, including, but not limited to, a plastic bottle, a metal can, a glass bottle, or any other vessel configured to contain a material. A nonlimiting example of the labeling assembly 10 can include a CONTROL system for reel-fed wrap-around labelling, manufactured by Krones AG, which has a corporate headquarters in Neutraubling, Germany. It should be appreciated that the labeling assembly 10 can be a module or step in a process, such as a bottling line. It should also be appreciated that the labeling assembly 10 can be any suitable assembly for applying labels to a container, and is not limited to a specific manufacturer, process application, or technology.

The labeling assembly 10 can includes an unwind stand assembly 14, a splice assembly 16, and a label application assembly 18. The unwind stand assembly 14 is configured to selectively unwind a plurality of rolls of rolled stock 20, 24. More specifically, the unwind stand assembly 14 unwinds at least a first roll of rolled stock 20 and a second roll of rolled stock 24. The rolls of rolled stock 20, 24 are separately unwound. Stated another way, each roll of rolled stock 20, 24 can include its own unwind system to separately and independently unwind each roll of rolled stock 20, 24. The separate unwind systems further can concurrently unwind each roll of rolled stock 20, 24, for example during the splicing process, which is discussed further below.

Each roll of rolled stock 20, 24 supplies a respective web 26, 27 of stock to the splice assembly 16. More specifically, the first roll of rolled stock 20 supplies a first web of stock 26 to the splice assembly 16, while the second roll of rolled stock 24 supplies a second web of stock 27 to the splice assembly 16. Stated another way, the splice assembly 16 receives a plurality of webs of stock 26, 27, each from one of the plurality of rolls of rolled stock 20, 24. It should be appreciated that each web of stock 26, 27 is wound around a core 28 (shown in FIGS. 2-3) to form the respective roll of rolled stock 20, 24. The splice assembly 16 then selects one of the plurality of webs of stock 26, 27 as an active web of stock 29. The active web of stock 29 is then supplied to the application assembly 18. It should be appreciated that the rolled stock unwound from each roll 20, 24, and which becomes the web of stock 26, 27, can be referred to as rolled stock 26, 27.

The application assembly 18 receives the active web of stock 29. Concurrently, the application assembly 18 receives a plurality of containers 30. More specifically, the plurality of containers 30 supplied to the application assembly 18 are unlabeled containers 30*a*. The application assembly 18 receives the unlabeled containers 30*a*, modifies the active web of stock 29, which are a plurality of labels in web form, and then applies one label to each container 30*a*. More specifically, the application assembly 18 applies an adhesive to each label, applies one label to each container 30*a*, and cuts each label from the plurality of labels in web form 29. It should be appreciated that the application assembly 18 can perform the label application in any order and with additional, fewer, or different steps. The labeled containers 30*b* exit the application assembly 18 for further processing and/or packaging.

As previously noted, the splice assembly 16 is configured to transition between the plurality of webs of stock 26, 27 as the active web of stock 29. The transition occurs in order to maintain a continuous web of the active web of stock 29. Stated another way, the splice assembly 16 is configured to change (or select) from the plurality of webs of stock 26, 27 as the active web of stock 29. Accordingly, the splice assembly 16 is configured to change (or select) from the plurality of rolls of rolled stock 20, 24, which respectively supply the webs of stock 26, 27, as the supply for the active web of stock 29. To facilitate this transition, or splice, between rolls of rolled stock 20, 24, the splice assembly 16 can include a splice system. The splice system can be any suitable known or future developed system configured to transition from one web of material to a another, separate web of material to continuously supply the active web of stock 29.

To initiate the splice, the splice assembly 16 includes a manual splice actuation system 34. The manual splice actuation system 34 can include a user actuatable member (not shown), such as a switch, button, or other control that can be actuated by the user (or an operator) to initiate operation of the splice assembly 16. For example, actuating the control on the manual splice actuation system 34 can manually initiate operation of the splice assembly 16, triggering a splice from one of the webs 26, 27 to the other of the webs 27, 26. This in turn transitions one of the webs 26, 27 as the active web of stock 29 to the other of the webs 27, 26 as the active web of stock 29. Stated another way, the triggering the splice transitions one of rolls of rolled stock 20, 24 as the supply for the active web of stock 29 to the other of the rolls of rolled stock 24, 20 as the supply for the active web of stock 29. To facilitate communication, the manual splice actuation system 34 is in operable communication with the splice assembly 16 by a data connection 36 (also referred to as a first data connection 36 or a first communication connection 36).

It should be appreciated that the example of the embodiment of the labeling assembly 14 discussed herein illustrates two rolls of rolled stock 20, 24, and more specifically two rolls 20, 24 of labels. The two rolls are provided for purposes of illustration, and are not intended to be limiting. The labeling assembly 14 includes at least two rolls of rolled stock 20, 24. In other examples of embodiments the plurality of rolls of rolled stock 20, 24 include more than two rolls. Systems can include three, four, five, or six or more rolls of rolled stock 20, 24 to supply the application assembly 18. Utilizing additional rolls of rolled stock reduces the frequency of changing unwound rolls with new, fully wound rolls of rolled stock. As such, the first roll of rolled stock 20 can be any of the plurality of rolls of rolled stock, and the second roll of rolled stock 24 can be any other of the plurality of rolls of rolled stock. The splice assembly 16 simply changes between the rolls of rolled stock 20, 24 in order to provide a continuous web of as the active web of stock 29. It should be appreciated that while the assembly 10 illustrates two rolls of rolled stock 20, 24, the assembly 10 should be considered to include at least two rolls of rolled stock 20, 24. In other examples of embodiments, the assembly 10 can include any suitable number of rolls of rolled stock 20, 24 to facilitate operation. It should also be appreciated that the roll of rolled stock 20, 24 that is supplying the active web of stock 29 can be referred to as an active roll of rolled stock 20, 24.

With continued reference to FIG. 1, a detection assembly 100 (also referred to as a core detection assembly 100 or a stock on core detection assembly 100 or a sensor assembly 100) is operably connected to the assembly 10. The detection assembly 100 is configured to be retrofit to any suitable labeling assembly 10. In one or more examples of embodiments, a manufacturer can restrict access to certain control logic associated with the labeling assembly 10. As such, once the labeling assembly 10 is installed and operational, the party that purchased (and/or operates) the labeling assembly 10 is unable to access or otherwise change or modify the control logic. In these examples, the assembly 10 can include both an automatic splice actuation system and a manual splice actuation system that allows an operator to manually bypass the automatic splice actuation system. The detection assembly 100 advantageously can operate without requiring modification of the existing control logic on a labeling assembly 10, as the detection assembly is configured to communicate with the manual splice actuation system, which does not require access or modification of the inaccessible control logic of the automatic splice actuation system. Accordingly, the core detection assembly 100 can be installed on any known labeling assembly 10 as an aftermarket retrofit addition. In other examples of embodiments, the detection assembly 100 can advantageously operate with or without requiring modification of the existing control logic on the assembly 10. Accordingly, the detection assembly 100 can be installed on any known assembly 10 (or 50, discussed further below), as an aftermarket retrofit addition. It should be appreciated that in other examples of embodiments, the manufacturer can allow for communication of aftermarket components to communicate with certain components of the assembly 10, including but not limited to the splice actuation system 34.

The core detection assembly 100 includes a plurality of sensors 104. In the illustrated embodiment, there is one sensor 104 associated with each roll of rolled stock 20, 24. In the illustrated embodiment, the sensors 104 include a first sensor 104*a* and a second sensor 104*b*. The first sensor 104*a* is associated with the first roll of rolled stock 20, while the second sensor 104*b* is associated with the second roll of rolled stock 24. Each sensor 104*a, b* is configured to monitor the associated roll of rolled stock 20, 24, and detect a low level of stock remaining on the core. In the illustrated example of an embodiment, each sensor 104*a, b* is configured to detect the core when the core is exposed. Exposure of the core indicates that the stock on the associated roll has been fully used, and a splice to another roll is necessary.

Each sensor 104*a, b* can be mounted to the labeling assembly 10 in any suitable manner to orient the sensor 104*a, b* relative to the associated roll of rolled stock 20, 24 to facilitate detection of the core. For example, each sensor 104*a, b* can be mounted to the labeling assembly 10 using metal tubing, brackets, fasteners, or any other suitable mounting structure. In other examples of embodiments, each sensor 104*a, b* can be free standing. Each sensor 104*a, b* simply needs to be positioned to maintain the necessary orientation relative to the associated roll of rolled stock 20, 24 to detect the rolled stock 26, 27 and/or the core 28 during unwinding of each roll of rolled stock 20, 24 to support operation of the labeling assembly 10. In the illustrated embodiment, each sensor 104*a, b* is oriented perpendicular to an axis of rotation 38 of the associated rolled stock 20, 24 (shown in FIGS. 2-3). Stated another way, each sensor 104*a, b* includes an emitter 105*a, b* and a receiver 106*a, b* (shown in FIG. 1). The emitter 105*a, b* is oriented to emit a detection signal 112*a*, 112*b* that is aligned with a radius of the rolled stock 20, 24. Stated another way, the emitter 105*a, b* is oriented to emit a detection signal 112*a*, 112*b* that is perpendicular to the axis of rotation of the associated rolled stock 20, 24. The receiver 106*a, b* is oriented to receive the emitted signal 112*a, b*. In the illustrated embodiment each sensor 104*a, b* is a Q4X Series Laser Sensor sold by Banner Engineering Corp. headquartered in Minneapolis, Minnesota, USA. However, in other embodiments, any suitable sensor that can be configured to detect a rolled stock, a core of the rolled stock, and differentiate between the rolled stock and the core can be utilized in the core detection assembly 100. Thus, suitable sensors 104*a, b* can include, but are not limited to, laser, infrared, optical, or other photoelectric sensor. In addition, while the illustrated sensor 104 can be a diffuse-reflective type sensor, in other embodiments, the sensor 104 can be a through-beam sensor, retro-reflective sensor, or any other sensor configured to detect a change in surface conditions of an object. It should be appreciated that the axis of rotation 38 of the roll of rolled stock 20, 24 can be defined by the core 28 (or the axis of rotation of the core 28).

Each sensor 104*a, b* is in operable communication with the manual splice actuation system 34 by an associated data connection 108. More specifically, the first sensor 104*a* is in operable communication with the manual splice actuation system 34 by a data connection 108*a* (also referred to as a second data connection 108*a* or a second communication connection 108*a*). The second sensor 104*b* is in operable communication with the manual splice actuation system 34 by a data connection 108*b* (also referred to as a third data connection 108*b* or a third communication connection 108*b*). Each of the data connections 108 can be wired, wireless, or any suitable system for communication (e.g., radio, cellular, BLUETOOTH, 802.11 Wireless Networking protocol, etc.).

Each sensor 104*a, b* emits a signal 112*a, b*, and the receiver 106*a, b* (also referred to as a detector 106*a, b*) detects the emitted signal 112*a, b*. In the illustrated embodiment, the first sensor 104*a* emits a first signal 112*a*. The first signal 112*a* is emitted to the first roll of rolled stock 20. The receiver 106*a* of the first sensor 104*a* then detects the emitted first signal 112*a*. Similarly, the second sensor 104*b* emits a second signal 112*b*. The second signal 112*b* is emitted to the second roll of rolled stock 24. The receiver 106*b* of the second sensor 104*b* detects the emitted second signal 112*b*.

Figure 2:
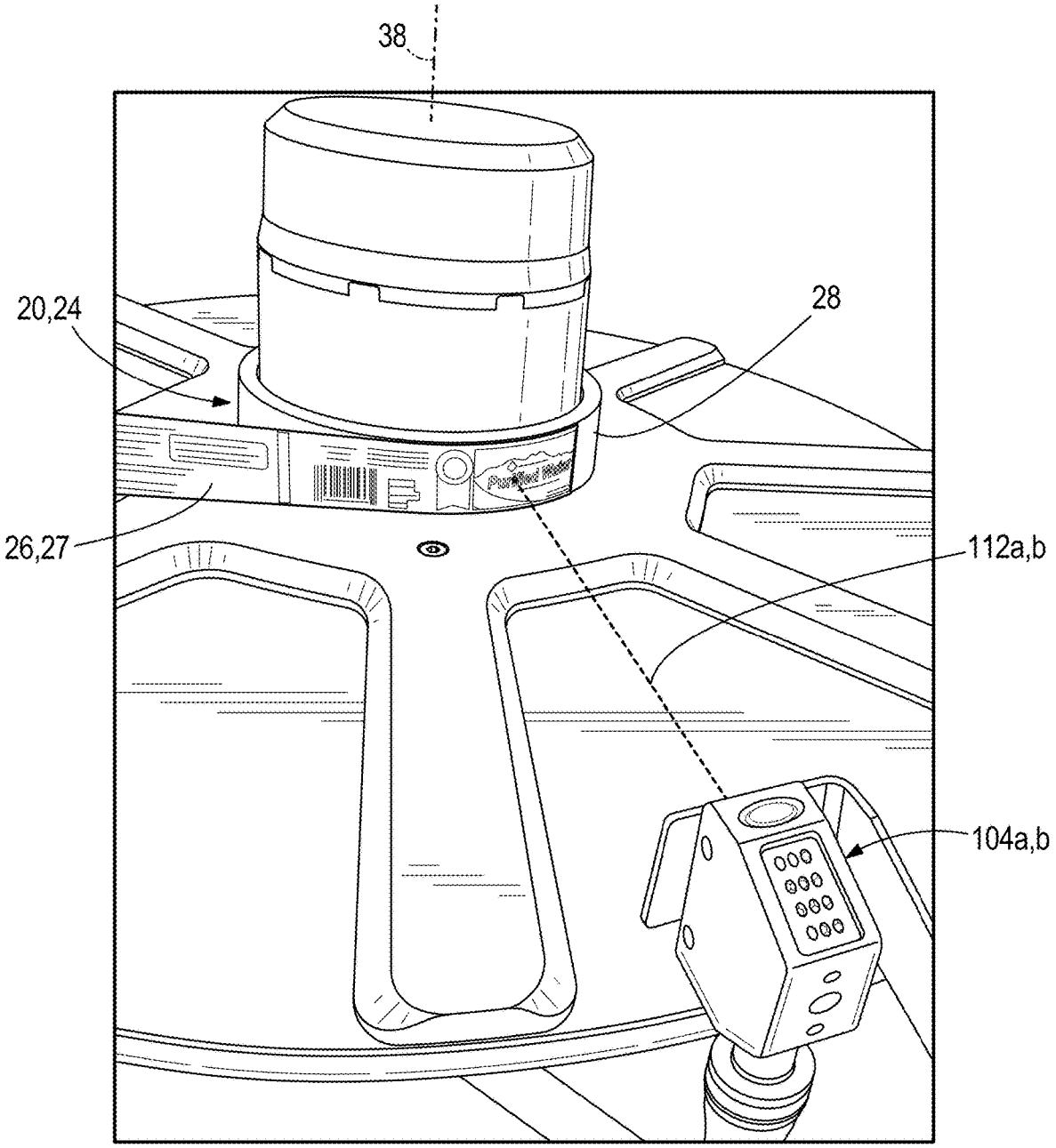
FIG. 2 is a perspective view of a sensor of the detection assembly of FIG. 1 in a first detection configuration detecting a first surface, shown as the rolled stock, and more specifically a label.
Figure 3:
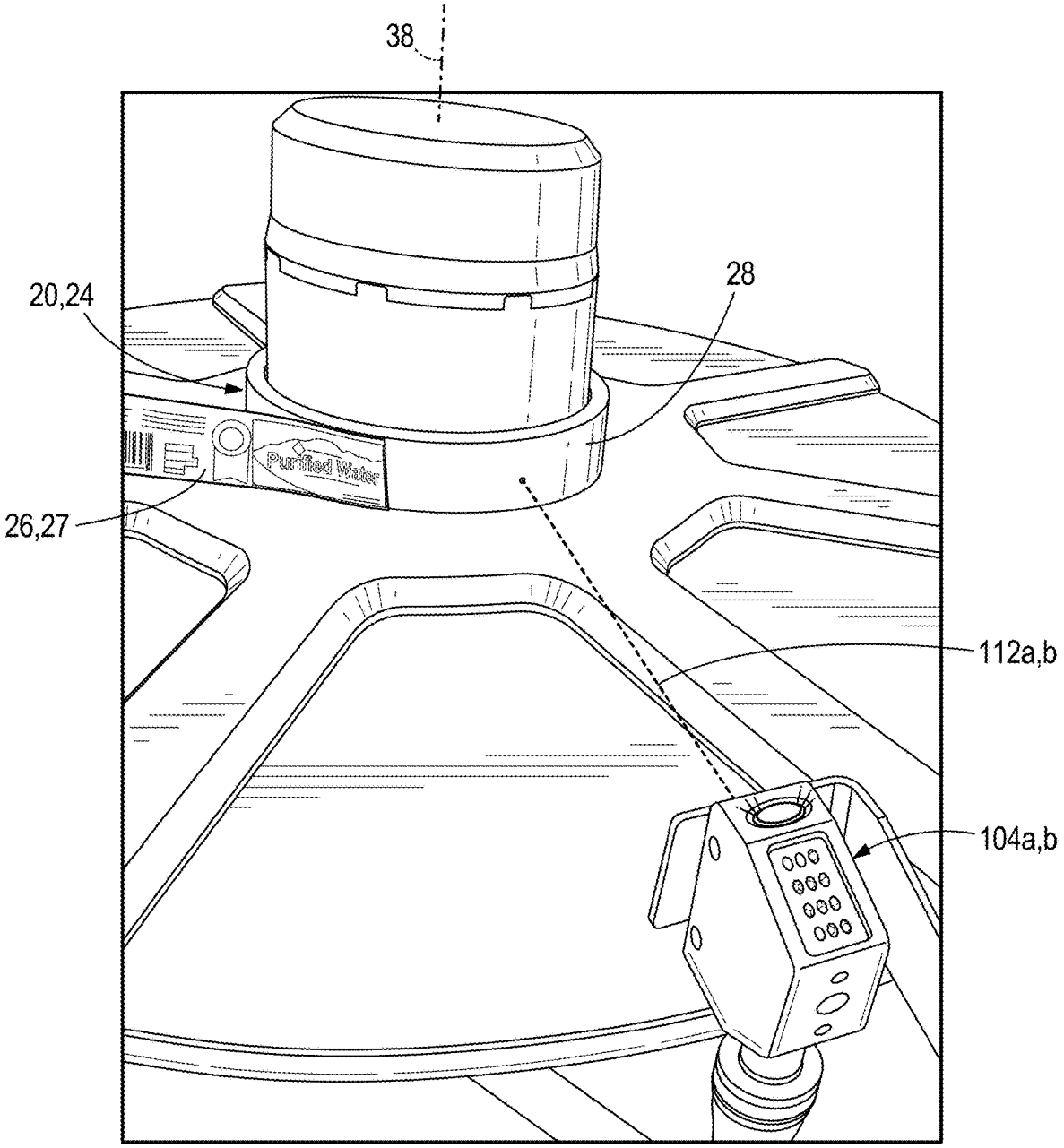
FIG. 3 is a perspective view of the sensor of the detection assembly of FIG. 1 in a second detection configuration detecting a second surface, shown as a core.

Each sensor 104*a*, 104*b* is programmed to detect a first surface and a second surface, the second surface being different from the first surface. Stated another way, each sensor 104*a*, 104*b* is programmed to detect a first detection configuration and a second detection configuration. With reference to FIG. 2, each sensor 104*a, b* is configured to detect the first detection configuration and detect the first surface, which is the rolled stock 26, 27 (or stock rolled on the core 28). In the illustrated embodiment, the rolled stock 26, 27 is the roll of labels. With reference to FIG. 3, each sensor 104*a, b* is also configured to detect the second detection configuration and detect the second surface, which is the core 28 of the roll of rolled stock 20, 24. In programming each sensor 104*a*, 104*b*, the sensor is configured to detect the first surface 26, 27 and the second surface 28. To detect the change in surface conditions, each sensor 104*a*, 104*b* can be programmed to detect changes in reflectivity, opacity, whiteness/brightness, color, refractivity, or any other property suitable for differentiating the first surface from the second surface. A detected change between the first surface 26, 27 and the second surface 28 results in detection of a responsive change in surface conditions of the roll of rolled stock 20, 24. Stated another way, the programmed detected change in surface conditions between the first surface 26, 27 and second surface 28 results in an indication that all of the rolled stock 26, 27 is empty. The first surface 26, 27 (i.e., the rolled stock or rolled labels) are completely unwound (or used) exposing the second surface 28 (i.e., the core 28 of the roll).

Figure 4:
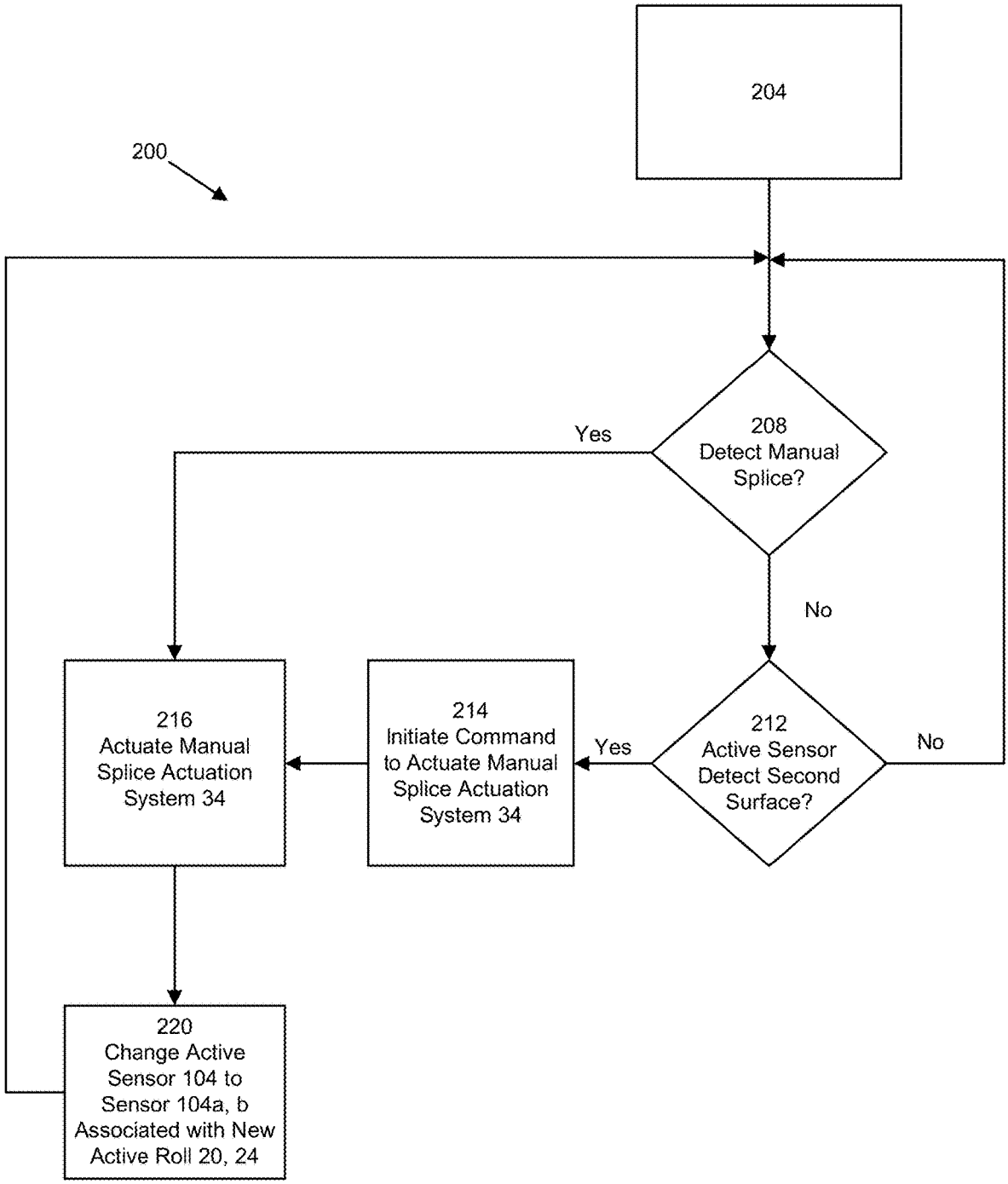
FIG. 4 is a flow diagram of an embodiment of a detection and control system for use with the core detection assembly of FIG. 1.

FIG. 4 illustrates an example of an embodiment of a detection and control system 200 that utilizes information detected by the sensors 104*a*, 104*b* to initiate a splice between rolls of rolled stock 20, 24. The system 200 operates in association with the detection assembly 100 to advantageously reduces waste by initiating the splice in response to the core of the active roll of stock 20 or 24 being exposed and subsequently detected by the associated sensor 104*a* or 104*b*. This maximizes use of the rolled stock 26 or 27 that is stored on the respective roll 20 or 24. The system 200 is in communication with the manual splice actuation system 34 to initiate actuation of the manual splice actuation system 34. This advantageously facilitates a retrofit addition of the detection assembly 100 and associated system 200 to any suitable labeling assembly 10.

The detection and control system 200 can be integrated into the detection assembly 100. For example, the system 200 can be a separate controller (not shown) configured to receive information detected by the sensors 104*a*, 104*b*, and further selectively communicate commands to actuate the manual splice actuation system 34 of any suitable labeling assembly 10. In other examples of embodiments, the system 200 can be operably connected to the manual splice actuation system 34 to initiate selective operation of the manual splice actuation system 34 in response to the information detected and communicated by the sensors 104 of the core detection assembly 100. The core detection and control system 200 includes a series of processing instructions or steps that are depicted in flow diagram form.

Referring to FIG. 4, the process of the core detection and control system 200 begins at step 204. At step 204, the labeling assembly 10 is operating to apply labels to containers 30. One of the plurality of rolls of rolled stock 20, 24 is the active roll of rolled stock 20 or 24. The sensor 104*a* or 104*b* that is associated with the active roll 20 or 24 is the active sensor 104*a* or 104*b*. The active roll of rolled stock 20 or 24 is being unwound, with the associated unwound web of stock 26 or 27 being the active web of stock 29. It should be appreciated that the roll of rolled stock 20, 24 can be any two rolls of a plurality of rolls of stock. Stated another way, there can be two or more rolls of rolled stock in the plurality of rolls of stock.

At step 208, the system 200 detects whether the manual splice actuation system 34 has been actuated. More specifically, the system 200 detects whether an operator or other user has manually actuated the manual splice actuation system 34, such as by actuating the user actuatable member. If the process does not detect that the manual splice actuation system 34 has been actuated, or "no," the process proceeds to step 212. If the process does detect that the manual splice actuation system 34 has been actuated, or "yes," the process proceeds to step 216.

At step 212, the system 200 receives detection data from the active sensor 104*a* or 104*b*. The process then determines whether the active sensor 104*a* or 104*b* detects the second surface (i.e., the core of the active roll). If the active sensor 104*a* or 104*b* detects the first surface of the active roll 20 or 24, or "no," the active sensor 104*a* or 104*b* is detecting the unwinding stock 26 or 27. The process then returns to step 208 and repeats. If the active sensor 104*a* or 104*b* detects the second surface of the active roll 20 or 24, or "yes," the active sensor 104*a* or 104*b* is detecting the core of the active roll 20 or 24. This indicates that the active roll 20 or 24 is completely unwound by exposing the core. The process proceeds to step 214, where a command is initiated (and sent) to actuate the manual splice actuation system 34. The manual splice actuation system 34 receives this command, and proceeds to step 216.

At step 216, the manual splice actuation system 34 initiates a splice from the active roll to a secondary roll. It should be appreciated that in response to detecting actuation of the manual splice at step 208, an operator has manually initiated actuation of the manual splice. For example, the operator has actuated the user actuatable member to initiate a splice through the manual splice actuation system 34. It should be appreciated that in response to the active sensor 104*a* or 104*b* detecting the second surface of the active roll (or detecting the core) at step 212, the process initiates the command to operate the manual splice actuation system 34 at step 214.

The manual splice actuation system 34 transitions the active roll. For example, in one embodiment, where the first roll 20 is the active roll, the actuation of the manual splice actuation system 34 transitions from the first roll 20 to the second roll 24 as the active roll. After completion of the splice, the second roll 24 becomes the active roll, with the unwound web of stock 27 being the active web of stock 29. In another example of an embodiment, where the second roll 24 is the active roll, actuation of the manual splice actuation system 34 transitions from the second roll 24 to the first roll 20 as the active roll. After completion of the splice, the first roll 20 becomes the active roll, with the unwound web of stock 26 being the active web of stock 29. Again, it should be appreciated that in examples of embodiments of the unwind stand assembly 14 having three or more rolls, the first roll 20 and the second roll 24 can be any two rolls of the three or more rolls. After the successful splice and transition of the active roll, the completed roll (or roll that was spliced out) can be removed and replaced with a new roll. The new roll can later be spliced in for use when one (or more) other rolls used.

After the successful splice, the process proceeds to step 220 where the active sensor is transitioned. More specifically, the active sensor is transitioned from the completed roll (or the roll spliced out) to the new active roll (or the roll spliced in). In the embodiments where the splice transitions from the first roll 20 to the second roll 24, the active sensor transitions from the first sensor 104*a* to the second sensor 104*b*. Similarly, in the embodiment where the splice transitions from the second roll 24 to the first roll 20, the active sensor transitions from the second sensor 104*b* to the first sensor 104*a*. Following reassignment of the active sensor 104*a* or 104*b* for monitoring the change in active roll 20 or 24, the process then returns to step 208, where the detection of either a manual splice (at step 208) or the second surface (at step 212) repeats for the new active roll.

Figure 5:
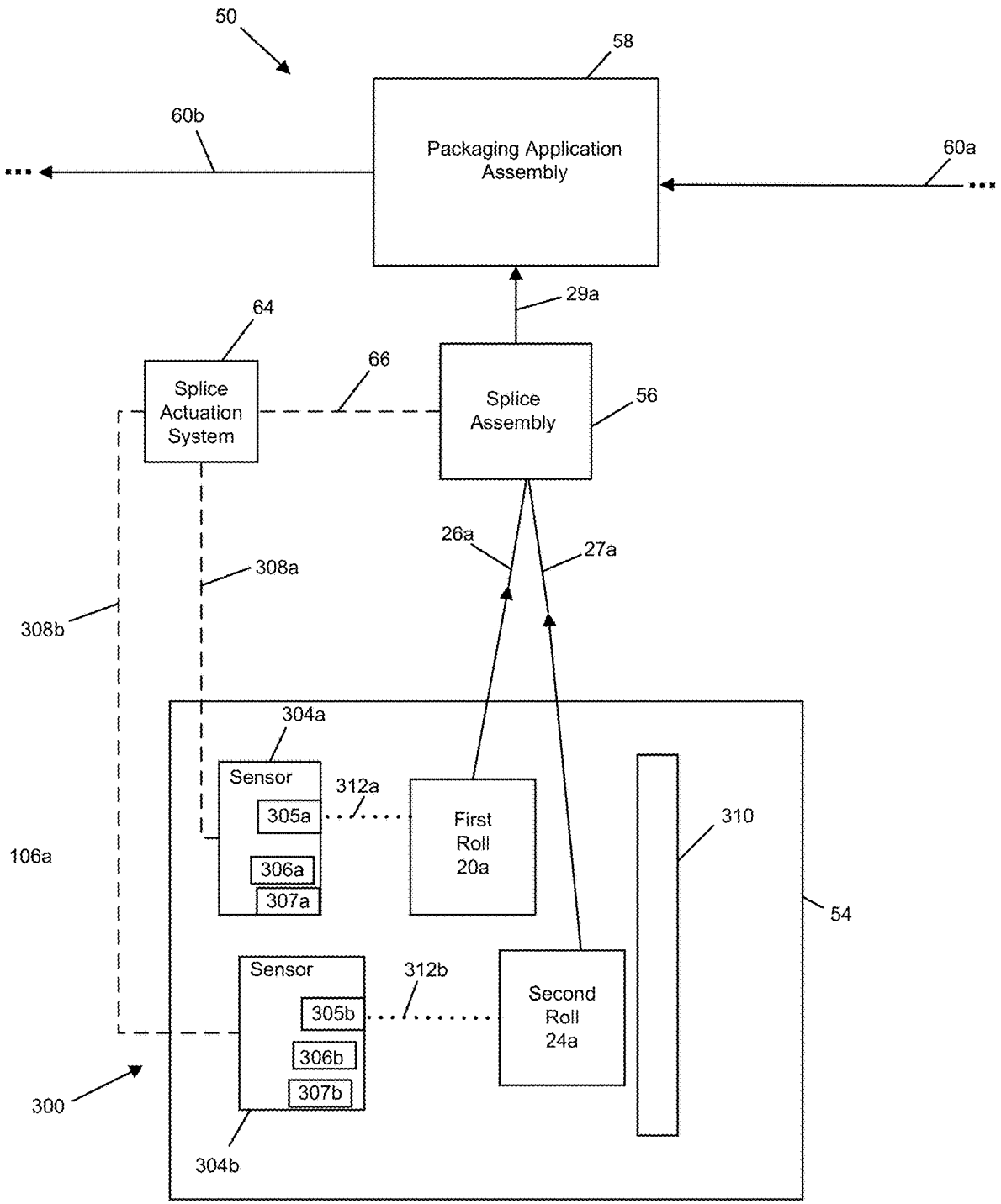
FIG. 5 is a schematic diagram of an example of a portion of a packaging assembly utilizing rolled stock from a plurality of rolls that integrates another example of an embodiment of a detection assembly.

With reference now to FIG. 5, a schematic diagram of an example of an embodiment of a portion of an assembly 50 utilizing rolled stock is provided. The illustrated assembly 50 is a packaging assembly 50. The packaging assembly 50 is configured to apply packaging material that is supplied as rolled stock. The packaging assembly 50 incorporates another example of an embodiment of a detection system 300 configured to reduce rolled stock waste. It should be appreciated that the illustrated portion of the packaging assembly 50 can be a module or step in a process, such as a packaging line. It should also be appreciated that the packaging assembly 50 can be any suitable assembly for applying packaging material to a package, and is not limited to a specific manufacturer, process application, or technology. In the illustrated embodiment, the packaging material is a film configured for shrink wrapping. In other examples of embodiments, the packaging material can be any suitable packaging material provided in roll form that is unwound for use by the packaging assembly and that incorporates the detection system 300.

The packaging assembly 50 can includes an unwind stand assembly 54, a splice assembly 56, and a packaging application assembly 58. The unwind stand assembly 54 is configured to selectively unwind a plurality of rolls of rolled stock 20*a*, 24*a*. More specifically, the unwind stand assembly 54 unwinds at least a first roll of rolled stock 20*a* and a second roll of rolled stock 24*a*. The rolls of rolled stock 20*a*, 24*a* are separately unwound. Stated another way, each roll of rolled stock 20*a*, 24*a* can include its own unwind system to separately and independently unwind each roll of rolled stock 20*a*, 24*a*. The separate unwind systems further can concurrently unwind each roll of rolled stock 20*a*, 24*a*, such as during the splicing process, which is discussed further below.

Each roll of rolled stock 20*a*, 24*a* supplies a respective web 26*a*, 27*a* of stock to the splice assembly 56. More specifically, the first roll of rolled stock 20*a* supplies a first web of stock 26*a* to the splice assembly 56, while the second roll of rolled stock 24*a* supplies a second web of stock 27*a* to the splice assembly 56. Stated another way, the splice assembly 56 receives a plurality of webs of stock 26*a*, 27*a*, each from one of the plurality of rolls of rolled stock 20*a*, 24*a*. It should be appreciated that each web of stock 26*a*, 27*a* is wound around a core 28*a* (shown in FIGS. 6-7) to form the respective roll of rolled stock 20*a*, 24*a*. The splice assembly 56 then selects one of the plurality of webs of stock 26*a*, 27*a* as an active web of stock 29*a*. The active web of stock 29*a* is then supplied to the packaging application assembly 58. It should be appreciated that the rolled stock unwound from each roll 20*a*, 24*a*, and which becomes the web of stock 26*a*, 27*a*, can be referred to as rolled stock 26*a*, 27*a*.

The application assembly 58 receives the active web of stock 29*a*. Concurrently, the application assembly 58 receives a package 60*a* requiring application of the rolled stock (e.g., packaging shrink wrap, packaging wrap, etc.). More specifically, a plurality of containers supplied to the application assembly 58 can be arranged in a package orientation, such as a case or a plurality of containers that is not wrapped. The application assembly 58 receives the package 60*a*, modifies the active web of stock 29*a*, which is packaging, and then applies the packaging to the package 60*a*. More specifically, the application assembly 58 applies the packaging wrap 29*a* around the package 60*a*, and cuts the packaging wrap 29*a* from the wrap 29*a* in web form 29*a*. It should be appreciated that the application assembly 58 can perform the packaging application in any order and with additional, fewer, or different steps. The wrapped package 60*b* then exit the application assembly 58 for further processing and/or packaging. For example, the wrapped package 60*b* can be finally packaged and transferred for shipping, or the wrapped package 60*b* can proceed to an additional step, such as a heat tunnel of a shrink wrap process (or any other suitable additional step to complete packaging.

The splice assembly 66 is configured to transition between the plurality of webs of stock 26*a*, 27*a* as the active web of stock 29*a*. The transition occurs in order to maintain a continuous web of the active web of stock 29*a*. Stated another way, the splice assembly 56 is configured to change (or select) from the plurality of webs of stock 26*a*, 27*a* as the active web of stock 29*a*. Accordingly, the splice assembly 56 is configured to change (or select) from the plurality of rolls of rolled stock 20*a*, 24*a*, which respectively supply the webs of stock 26*a*, 27*a*, as the supply for the active web of stock 29*a*. To facilitate this transition (or splice) between rolls of rolled stock 20*a*, 24*a*, the splice assembly 56 can include a splice system. The splice system can be any suitable known or future developed system configured to transition from one web of material to a another, separate web of material to continuously supply the active web of stock 29*a*.

To initiate the splice, the splice assembly 56 includes a splice actuation system 64. The splice actuation system 64 can be an automatic system that is integrated into the packaging assembly 50, or it can be a manual system that includes a user actuatable member (not shown), such as a switch, button, or other control that can be actuated by the user (or an operator) to initiate operation of the splice assembly 56. The splice actuation system 64 can initiate operation of the splice assembly 56 in response to operator interaction (manual splice) or in response to a command from a control system (automatic splice), triggering a splice from one of the webs 26*a*, 27*a* to the other of the webs 27*a*, 26*a*. This in turn transitions one of the webs 26*a*, 27*a* as the active web of stock 29*a* to the other of the webs 27*a*, 26*a* as the active web of stock 29*a*. Stated another way, the triggering the splice transitions one of rolls of rolled stock 20*a*, 24*a* as the supply for the active web of stock 29*a* to the other of the rolls of rolled stock 24*a*, 20*a* as the supply for the active web of stock 29*a*. To facilitate communication, the splice actuation system 64 is in operable communication with the splice assembly 56 by a data connection 66 (also referred to as a first data connection 66 or a first communication connection 66).

It should be appreciated that the example of the embodiment of the packaging assembly 50 discussed herein illustrates two rolls of rolled stock 20*a*, 24*a*, and more specifically two rolls 20*a*, 24*a* of packaging material. The two rolls are provided for purposes of illustration, and are not intended to be limiting. The packaging assembly 54 includes at least two rolls of rolled stock 20*a*, 24*a*. In other examples of embodiments the plurality of rolls of rolled stock 20*a*, 24*a* include more than two rolls. Systems can include three, four, five, or six or more rolls of rolled stock 20*a*, 24*a* to supply the application assembly 58. Utilizing additional rolls of rolled stock reduces the frequency of changing unwound rolls with new, fully wound rolls of rolled stock. As such, the first roll of rolled stock 20*a* can be any of the plurality of rolls of rolled stock, and the second roll of rolled stock 24*a* can be any other of the plurality of rolls of rolled stock. The splice assembly 56 simply changes between the rolls of rolled stock 20*a*, 24*a* to provide a continuous web of as the active web of stock 29*a*. It should be appreciated that while the assembly 50 illustrates two rolls of rolled stock 20*a*, 24*a*, the assembly 50 should be considered to include at least two rolls of rolled stock 20*a*, 24*a*. In other examples of embodiments, the assembly 50 can include any suitable number of rolls of rolled stock 20*a*, 24*a* to facilitate operation. It should also be appreciated that the roll of rolled stock 20*a*, 24*a* that is supplying the active web of stock 29*a* can be referred to as an active roll of rolled stock 20*a*, 24*a*.

With continued reference to FIG. 5, a detection assembly 300 (also referred to as a core detection assembly 300 or a stock on core detection assembly 300 or a sensor assembly 300) is operably connected to the assembly 50. The detection assembly 300 is configured to be retrofit to any suitable packaging assembly 50. In one or more examples of embodiments, a manufacturer can allow for communication of aftermarket components to communicate with certain components of the assembly 50. In the illustrated embodiment, the detection assembly 300 is configured to communicate with the splice actuation system 64. In other examples of embodiments, the manufacturer of the assembly 50 can restrict access to certain control logic associated with the assembly 50. As such, once the assembly 50 is installed and operational, the party that purchased (and/or operates) the assembly 50 is unable to access or otherwise change or modify the control logic. The detection assembly 300 can advantageously operate with or without requiring modification of the existing control logic on the assembly 50. Accordingly, the detection assembly 300 can be installed on any known assembly 10, 50 as an aftermarket retrofit addition.

It should also be appreciated that the assembly 10, 50 discussed above, though different operationally, have common components for utilizing rolled stock. As such, it should be appreciated that each detection assembly 100, 300 can be utilized on either assembly 10, 50. As such, the embodiments of the detection assembly 100, 300 are not limited for use in association with a certain or specific assembly (e.g., the label assembly 10, the packaging assembly 50, etc.). Instead, the detection assemblies 100, 300 can be implemented in association with any suitable assembly 10, 50 that utilizes a plurality of rolled stock in a continuous web process, and that includes at least two rolls of stock 20, 24, 20*a*, 24*a*, and a splice assembly 36, 56 to form a continuous active web of stock 29, 29*a*.

With continued reference to FIG. 5, The detection assembly 300 includes a plurality of sensors 304. In the illustrated embodiment, a sensor 304 is associated with each roll of rolled stock 20*a*, 24*a*. In the illustrated embodiment, the sensors 304 include a first sensor 304*a* and a second sensor 304*b*. The first sensor 304*a* is associated with the first roll of rolled stock 20*a*, while the second sensor 304*b* is associated with the second roll of rolled stock 24*a*. Each sensor 304*a, b* is configured to monitor the associated roll of rolled stock 20*a*, 24*a*, and detect a low level of stock remaining on the core. In the illustrated example of an embodiment, each sensor 304*a, b* is configured to detect a low level of rolled stock on the core that indicates that the stock on the associated roll has been fully used, and a splice to another roll is necessary.

Each sensor 304*a, b* can be mounted to the assembly 50 in any suitable manner to orient the sensor 304*a, b* relative to the associated roll of rolled stock 20*a*, 24*a* to facilitate detection of the core. For example, each sensor 304*a, b* can be mounted to the packaging assembly 50 using metal tubing, brackets, fasteners, or any other suitable mounting structure. In other examples of embodiments, each sensor 304*a, b* can be free standing. Each sensor 304*a, b* simply needs to be positioned to maintain the necessary orientation relative to the associated roll of rolled stock 20*a*, 24*a* to detect the rolled stock 26*a*, 27*a* and/or the core 28 during unwinding of each roll of rolled stock 20*a*, 24*a* to support operation of the assembly 50. In the illustrated embodiment, each sensor 304*a, b* is oriented parallel to an axis of rotation 38*a* of the associated rolled stock 20*a*, 24*a* (shown in FIGS. 6-7). Stated another way, each sensor 304*a, b* includes an emitter 305*a, b* and a receiver 306*a, b* (shown in FIG. 5). The emitter 305*a, b* is oriented to emit a detection signal 312*a*, 312*b* that is aligned (or parallel) with an axis of rotation of the core (or parallel to the core) of the rolled stock 20*a*, 24*a*. Stated another way, the emitter 305*a, b* is oriented to emit a detection signal 312*a*, 312*b* that is parallel to the axis of rotation of the associated rolled stock 20*a*, 24*a*. The receiver 306*a, b* is oriented to receive the emitted signal 312*a, b*. Each sensor 304*a, b* also includes a light source 307*a*, 307*b* (also referred to as an illumination source 307*a*, 307*b*). The light source 307*a*, 307*b* is configured to emit light to illuminate a portion of the roll of rolled stock 20*a*, 24*a* including the core and the rolled stock remaining on the core. In other examples of embodiments, the light source 307*a*, 307*b* can be external to the sensor 304*a, b*.

In the illustrated embodiment each sensor 304*a, b* is a IV3 Series Vision Sensor with Built-in AI sold by Keyence Corporation of America headquartered in Itasca, Illinois, USA. However, in other embodiments, any suitable sensor that can be configured to detect a rolled stock, a core of the rolled stock, and differentiate between the rolled stock and the core can be utilized in the core detection assembly 300. Thus, suitable sensors 304*a, b* can include, but are not limited to, laser, infrared, optical, or other photoelectric sensor. In addition, while the illustrated sensor 304 can be a machine-vision type sensor, in other embodiments, the sensor 304 can be a through-beam sensor, retro-reflective sensor, diffuse-reflective, or any other sensor configured to detect an object, a feature of an object, a geometry of an object, a volume of an object, a change in geometry of an object, or a change in volume of an object, or portions of the object.

Each sensor 304*a, b* is in operable communication with the splice actuation system 64 by an associated data connection 308. More specifically, the first sensor 304*a* is in operable communication with the splice actuation system 64 by a data connection 308*a* (also referred to as a second data connection 308*a* or a second communication connection 308*a*). The second sensor 304*b* is in operable communication with the splice actuation system 34 by a data connection 308*b* (also referred to as a third data connection 308*b* or a third communication connection 308*b*). Each of the data connections 308 can be wired, wireless, or any suitable system for communication (e.g., radio, cellular, BLUETOOTH, 802.11 Wireless Networking protocol, etc.).

Each sensor 304*a, b* emits a signal 312*a, b*, and the receiver 306*a, b* (also referred to as a detector 306*a, b*) detects the emitted signal 312*a, b*. In the illustrated embodiment, the first sensor 304*a* emits a first signal 312*a*. The first signal 312*a* is emitted to the first roll of rolled stock 20*a*. The receiver 306*a* of the first sensor 304*a* then detects the emitted first signal 312*a*. Similarly, the second sensor 304*b* emits a second signal 312*b*. The second signal 312*b* is emitted to the second roll of rolled stock 24*a*. The receiver 306*b* of the second sensor 304*b* detects the emitted second signal 312*b*. To assist with detection of the emitted signals 312*a*, 312*b*, the light source 307*a*, 307*b* of each sensor 304*a, b* illuminates at least a portion of the associated roll of rolled stock 20*a*, 24*b*. A background 310 can be positioned on a side of the rolls 20*a*, 24*a* opposite the sensors 304*a, b*. The background 310 has a color that is a first color (or a first reference color) that is generally black (or very dark) to provide contrast between the background and the detected core and rolled stock on the core.

Figure 6:
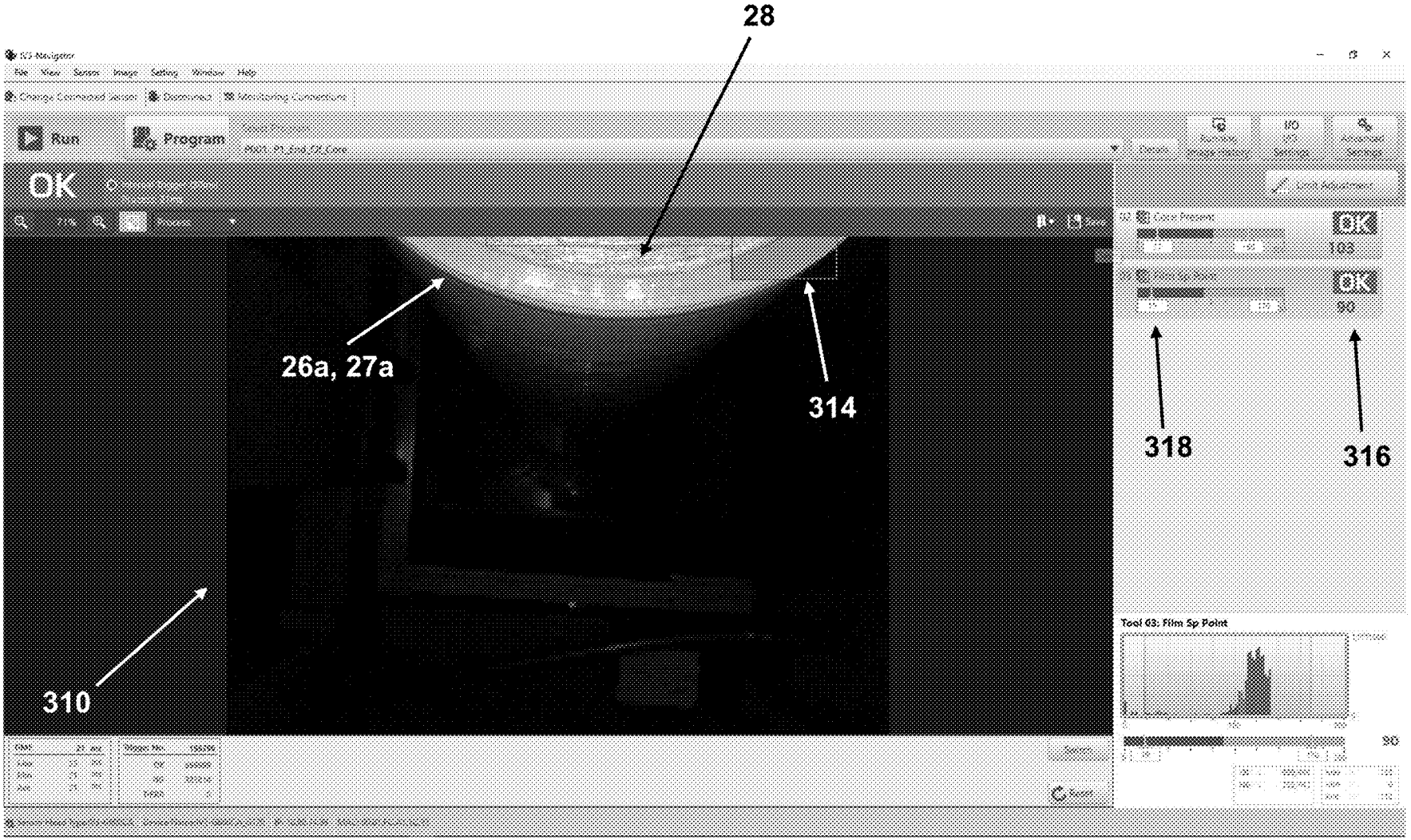
FIG. 6 is an example of an output detected by each sensor represented on a control monitor in a first detection configuration.

Each sensor 304*a*, 304*b* is programmed to detect a value of rolled stock remaining on the core. The value is a predetermined (or programmed) value representative of a low level threshold of rolled stock on the core and requiring actuation of the splice assembly 56. With reference now to FIG. 6, which is an example of an output detected by each sensor 304*a, b* represented on a control monitor in a first detection configuration. Each sensor 304*a, b* detects an amount of rolled stock 26*a*, 27*a* remaining on the core 28. The detected quantity of rolled stock 26*a*, 27*a* and the core 28 are illustrated relative to the darker background 310. Each sensor 304*a*, 304*b* is configured to use color to differentiate between the rolled stock 26*a*, 27*a* on the core 28 and the core 28. Each sensor 304*a*, 304*b* utilizes machine vision to detect an amount of rolled stock 26*a*, 27*a* remaining on the core 28. In one example, each sensor 304*a*, 304*b* can detect a portion of the rolled stock 26*a*, 27*a*, and utilize geometric based machine vision to detect a dimension 314 of rolled stock 26*a*, 27*a* remaining on the core 38. Each sensor 304*a*, 304*b* can include a preprogrammed dimension that is associated with a low level threshold 318 (or a low level quantity 318) of rolled stock 26*a*, 27*a* remaining on the core 28. The dimension data detected by each sensor 304*a*, 304*b* can be analyzed relative to the preprogrammed low level threshold 318. In another example, each sensor 304*a*, 304*b* is configured to detect a portion of the rolled stock 26*a*, 27*a*, and utilize volumetric based machine vision to detect a volume 314 of rolled stock 26*a*, 27*a* remaining on the core 28. to capture volumetric data associated with a portion of the rolled stock 26*a*, 27*a* remaining on the core 28. The sensors 304*a*, 304*b* are programmed to associate the detected volumetric data with the detected portion 314 of the rolled stock 26*a*, 27*a*. The volumetric data is programmed to be associated with a quantity of rolled stock 26*a*, 27*a* remaining on the core 28. Accordingly, each sensor 304*a*,

304*b* actively detects and monitors the quantity of rolled stock 26*a*, 27*a* remaining on the core 28, updating the detected geometric data as an associated value 316 relative to a preprogrammed low level limit value 318 (also referred to as a low level threshold 318).

In the first detection configuration, the value (or quantity) of rolled stock 26*a*, 27*a* remaining on the core 28 is above (or greater than) the low level threshold 318. Accordingly, each sensor 304*a*, 304*b* actively detects and monitors the quantity of rolled stock 26*a*, 27*a* remaining on the core 28, updating the detected dimension data as an associated value 316 relative to a preprogrammed low level limit value 318 (also referred to as the low level threshold 318). In the first detection configuration, the value (or quantity) of rolled stock 26*a*, 27*a* remaining on the core 28 is above (or greater than) the low level threshold 318. It should be appreciated that the sensors 304*a*, 304*b* can utilize any appropriate machine vision system to detect a portion 314 of the rolled stock 26*a*, 27*a* remaining on the core 38. As a nonlimiting example, the sensors 304*a*, 304*b* can utilize geometric, volumetric, laser triangulation, coded light, structured light, active stereo vision, or any other suitable or known machine vision technology.

Figure 7:
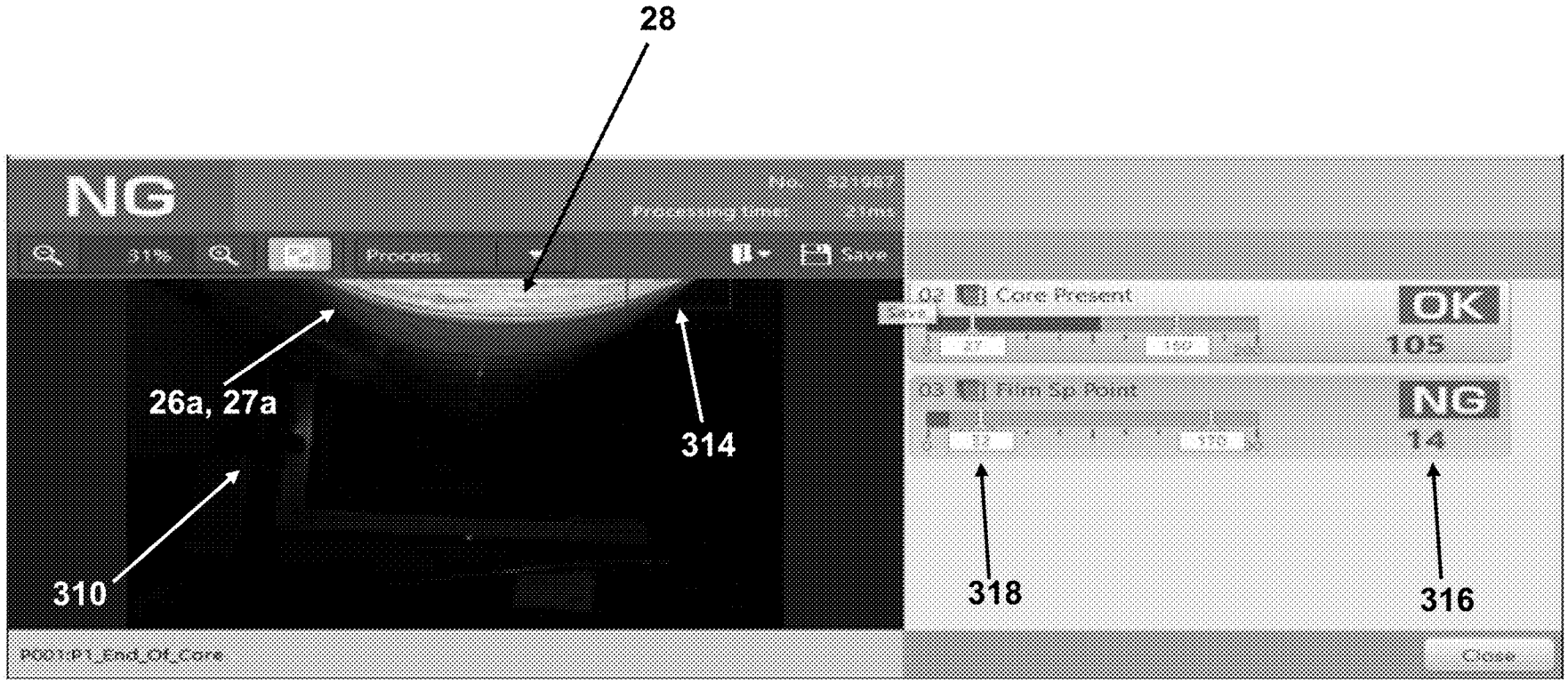
FIG. 7 is an example of an output detected by each sensor represented on a control monitor in a second detection configuration.

With reference now to FIG. 7, which is an example of an output detected by each sensor 304*a, b* represented on a control monitor in a second detection configuration. In the second detection configuration, the amount of rolled stock 26*a*, 27*a* remaining on the core 28, specifically the associated value 316, is at or less than the low level threshold 318. Stated another way, the detected amount of rolled stock 26*a*, 27*a* remaining on the core 28, as detected by each sensor 304*a*, 304*b*, is below (or at or below) the low level threshold 318. In one example, the detected geometric value 316 of rolled stock 26*a*, 27*a* remaining on the core 28 is below (or at or below) the low level threshold 318. In another example, the detected volumetric value 316 of rolled stock 26*a*, 27*a* remaining on the core 28 is below (or at or below) the low level threshold 318. In response to the detected amount of rolled stock 26*a*, 27*a* remaining on the core 28 being detected below (or at or below) the low level threshold 318, the associated sensor 304*a*, 304*b* communicates with the splice actuation system 64 to initiate a splice from one roll of rolled stock 20*a*, 24*a* to another roll of rolled stock 24*a*, 20*a*. It should be appreciated that the detected low level threshold 318 correlates to less than five impressions remaining on the core after the splice, and more specifically less than four impressions remaining on the core after the splice, and more specifically less than three impressions remaining on the core after the splice, and more specifically less than two impressions remaining on the core after the splice, and more specifically between approximately 1.5 and two impressions remaining on the core after the splice. It should be appreciated that the term "impressions" is intended to be interpreted as one full use of the rolled stock for the associated task. For example, one impression corresponds to a quantity of rolled stock to fully complete one task, such as wrapping one unit packaging, or labeling one bottle, etc.

Figure 8:
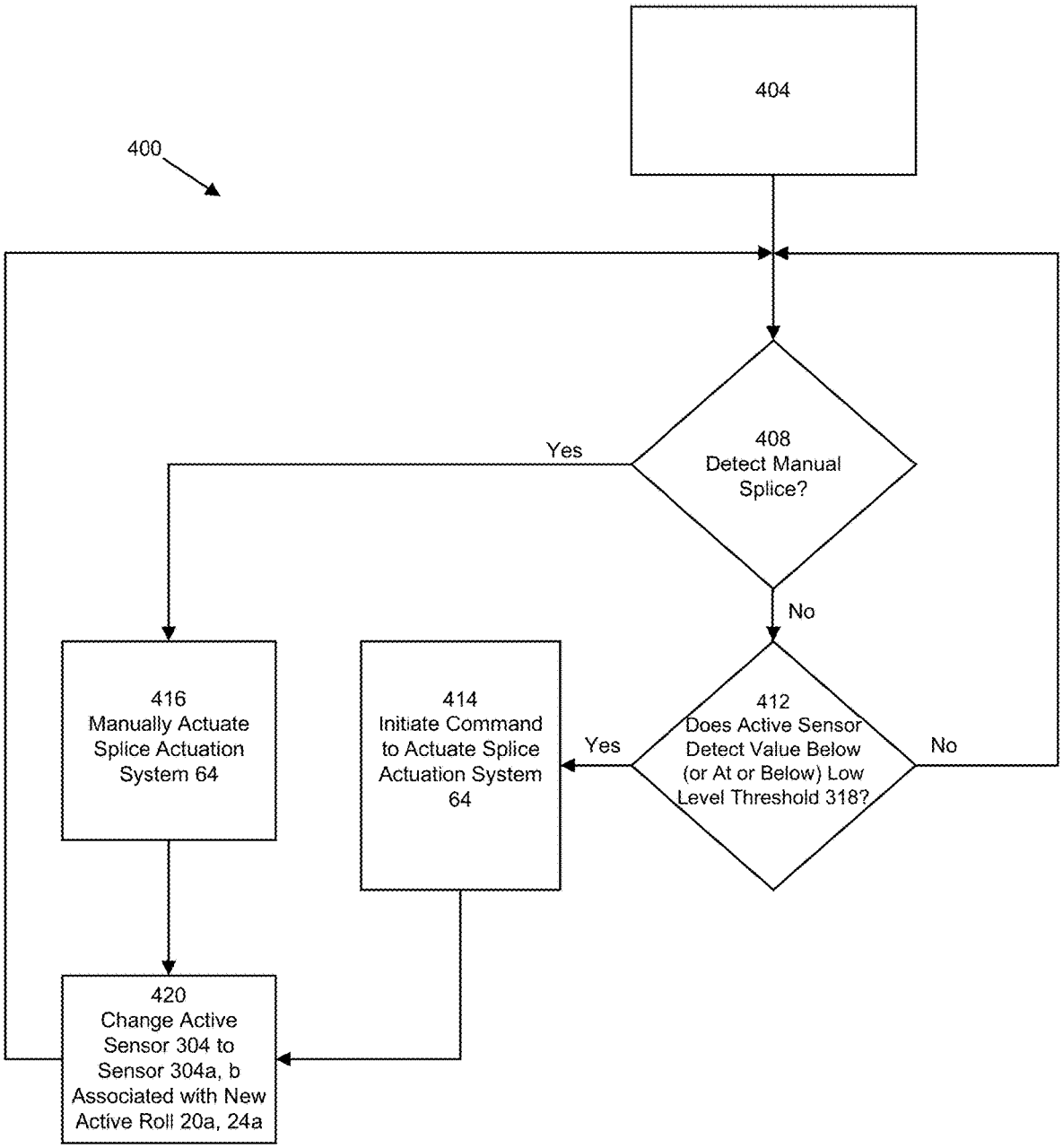
FIG. 8 is a flow diagram of an embodiment of a detection and control system for use with the core detection assembly of FIG. 5.

FIG. 8 illustrates an example of an embodiment of a detection and control system 400 that utilizes information detected by the sensors 304*a*, 304*b* to initiate a splice between rolls of rolled stock 20*a*, 24*a*. The system 400 operates in association with the detection assembly 300 to advantageously reduces waste by initiating the splice in response to the core of the active roll of stock 20*a* or 24*a* being exposed and subsequently detected by the associated sensor 304*a* or 304*b*. This maximizes use of the rolled stock 26*a* or 27*a* that is stored on the respective roll 20*a* or 24*a*. The system 400 is in communication with the splice actuation system 64 to initiate actuation of the splice assembly 56. This advantageously facilitates a retrofit addition of the detection assembly 300 and associated system 400 to any suitable assembly 10, 50.

The detection and control system 400 can be integrated into the detection assembly 300. For example, the system 400 can be a separate controller (not shown) configured to receive information detected by the sensors 304*a*, 304*b*, and further selectively communicate commands to actuate the splice actuation system 64 of any suitable assembly 50. In other examples of embodiments, the system 400 can be programmed (or integrated) into the sensors 304*a*, 304*b* and configured to communicate with the splice actuation system 64. In the illustrated embodiment, the system 400 is advantageously configured to communicate with the splice actuation system 64 without additional programming of a programmable logic controller (PLC). The detection and control system 400 includes a series of processing instructions or steps that are depicted in flow diagram form.

Referring now to FIG. 8, the process of the detection and control system 400 begins at step 404. At step 404, the packaging assembly 50 is operating to package containers 30. One of the plurality of rolls of rolled stock 20*a*, 24*a* is the active roll of rolled stock 20*a* or 24*a*. The sensor 304*a* or 304*b* that is associated with the active roll 20*a* or 24*a* is the active sensor 304*a* or 304*b*. The active roll of rolled stock 20*a* or 24*a* is being unwound, with the associated unwound web of stock 26*a* or 27*a* being the active web of stock 29*a*. It should be appreciated that the roll of rolled stock 20*a*, 24*a* can be any two rolls of a plurality of rolls of stock. Stated another way, there can be two or more rolls of rolled stock in the plurality of rolls of stock.

At step 404, the system 400 detects whether the splice actuation system 64 has been manually actuated. More specifically, the system 400 detects whether an operator or other user has manually actuated the splice actuation system 64, such as by actuating the user actuatable member. If the process does not detect that the splice actuation system 64 has been manually actuated, or "no," the process proceeds to step 412. If the process does detect that the splice actuation system 64 has been manually actuated, or "yes," the process proceeds to step 416.

At step 412, the system 400 receives detection data from the active sensor 304*a* or 304*b*. The process then determines where the detected value 316 by the active sensor 304*a* or 304*b* is relative to the low level threshold 318. If the active sensor 304*a* or 304*b* detects that the detected value 316, which can be a volumetric value representative of a quantity of rolled stock 26*a*, 27*a* remaining on the core 28, is greater than the low level threshold 318, or "no," the active sensor 304*a* or 304*b* is detecting a sufficient amount of rolled stock 26*a*, 27*a* unwinding from the core 28. The process then returns to step 208 and repeats. If the active sensor 304*a* or 304*b* detects that the detected value 316 is equal to or less than the low level threshold 318, or "yes," the active sensor 304*a* or 304*b* is detecting a low level of rolled stock on the core 28 of the active roll 20*a* or 24*a*. This indicates that the active roll 20*a* or 24*a* is nearing (or closing in on) completely being unwound and exposing the core. The process proceeds to step 414, where a command is initiated (and sent) to actuate the splice actuation system 64. The splice actuation system 64 receives this command, and instructs the splice assembly 56 to initiate a splice from the active roll of rolled stock 20*a*, 24*a* to the other roll of rolled stock 24*a*, 20*a*. The process then proceeds to step 420.

At step 416, the splice actuation system 64 manually initiates a splice from the active roll to a secondary roll. It should be appreciated that in response to detecting actuation of the manual splice at step 408, an operator has manually initiated actuation of the manual splice. For example, the operator has actuated the user actuatable member to initiate a splice through the manual splice actuation system 64. It should be appreciated that in response to the active sensor 304*a* or 304*b* detecting the second surface of the active roll (or detecting the core) at step 412, the process initiates the command to operate the splice actuation system 64 at step 414.

When the splice was actuated manually or automatically by a signal from the active sensor 304*a* or 304*b*, the splice actuation system 64 transitions the active roll. For example, in one embodiment, where the first roll 20*a* is the active roll, the actuation of the splice actuation system 64 transitions from the first roll 20*a* to the second roll 24*a* as the active roll. After completion of the splice by the splice assembly 56, the second roll 24*a* becomes the active roll, with the unwound web of stock 27*a* being the active web of stock 29*a*. In another example of an embodiment, where the second roll 24*a* is the active roll, actuation of the splice actuation system 54 transitions from the second roll 24*a* to the first roll 20*a* as the active roll. After completion of the splice by the splice assembly 56, the first roll 20*a* becomes the active roll, with the unwound web of stock 26*a* being the active web of stock 29*a*. Again, it should be appreciated that in examples of embodiments of the unwind stand assembly 54 having three or more rolls, the first roll 20*a* and the second roll 24*a* can be any two rolls of the three or more rolls. After the successful splice and transition of the active roll, the completed roll (or roll that was spliced out) can be removed and replaced with a new roll. The new roll can later be spliced in for use when one (or more) other rolls used.

After the successful splice, the process proceeds to step 420 where the active sensor is transitioned. More specifically, the active sensor is transitioned from the completed roll (or the roll spliced out) to the new active roll (or the roll spliced in). In the embodiments where the splice transitions from the first roll 20*a* to the second roll 24*a*, the active sensor transitions from the first sensor 304*a* to the second sensor 304*b*. Similarly, in the embodiment where the splice transitions from the second roll 24*a* to the first roll 20*a*, the active sensor transitions from the second sensor 304*b* to the first sensor 304*a*. Following reassignment of the active sensor 304*a* or 304*b* for monitoring the change in active roll 20*a* or 24*a*, the process then returns to step 408, where the detection of either a manual splice (at step 408) or a detection of a value that is below (or at or below) the low level threshold 318 (at step 412) repeats for the new active roll.

One or more aspects of the detection assembly 100, 300 and associated detection and control system 200, 400 provides certain advantages. As previously noted, the system 200, 400 and assembly 100, 300 reduces rolled stock (label or packaging) waste by initiating the splice in response to detection of the core. Thus, the rolled stock is almost entirely used, with only a few impressions (of labels or packaging) remaining after a successful splice. In addition, the assembly 100, 300 and associated system 200, 400 is configured to be a retrofit addition to any suitable labeling assembly 10, packaging assembly 50, or other assembly utilizing rolled stock in a continuous web process. The assembly 100, 300 and system 200, 400 can operate with a splice actuation system or a manual splice actuation system, and does not require access to restricted control logic associated with the assembly 10, 50. These and other advantages are realized by the disclosure provided herein.

What is claimed is:

1. A sensor assembly configured to detect rolled stock on a core comprising:

a sensor configured to detect a first roll of stock unwinding from a core, the stock unwinding from the core of the first roll is supplied as a web of stock, wherein in response to the sensor detecting a first detection configuration, the sensor takes no action and continues to detect the first roll, wherein in response to the sensor detecting a second detection configuration, the sensor provides a command to a splice assembly to transition to a second roll of stock to replace the first roll of stock, and wherein the first detection configuration includes detecting the stock on the core and the second detection configuration includes detecting the core.

2. The sensor assembly of claim 1, wherein the core defines an axis of rotation, the sensor is oriented relative to the first roll perpendicular to the axis of rotation.

3. The sensor assembly of claim 1, wherein the first detection configuration includes detecting a first quantity of stock on the core, the first quantity of stock is above a preprogrammed low level threshold.

4. The sensor assembly of claim 3, wherein the second detection configuration includes detecting a second quantity of stock on the core, the second quantity of stock does not exceed the preprogrammed low level threshold.

5. The sensor assembly of claim 4, wherein the core defines an axis of rotation, the sensor is oriented relative to the first roll parallel to the axis of rotation.

6. The sensor assembly of claim 4, wherein the sensor is configured to detect a portion of the first roll of stock including the core.

7. The sensor assembly of claim 4, wherein the sensor utilizes machine vision to detect the first and second quantity of stock on the core.

8. The sensor assembly of claim 7, wherein the machine vision captures volumetric data of the stock on the core.

9. The sensor assembly of claim 7, wherein the machine vision captures geometric data of the stock on the core.

10. The sensor assembly of claim 4, wherein the preprogrammed low level threshold corresponds to no more than five impressions of rolled stock remain on the core.

11. The sensor assembly of claim 4, wherein the preprogrammed low level threshold corresponds to no more than three impressions of rolled stock remain on the core.

12. The sensor assembly of claim 1, wherein the sensor includes a light source configured to illuminate a portion of the first roll.

13. The sensor assembly of claim 1, wherein in response to the transition to the second roll of stock, no more than five impressions of rolled stock remain on the core.

14. The sensor assembly of claim 1, wherein in response to the transition to the second roll of stock, no more than three impressions of rolled stock remain on the core.

15. The sensor assembly of claim 1, wherein in response to the transition to the second roll of stock, between 1.5 and 2 impressions of rolled stock remain on the core.

16. A sensor assembly configured to detect rolled stock on a core comprising:

a sensor configured to detect a first roll of stock unwinding from a core, the stock unwinding from the core of the first roll is supplied as a web of stock, wherein in response to the sensor detecting a first detection configuration, the sensor takes no action and continues to detect the first roll, wherein in response to the sensor detecting a second detection configuration, the sensor provides a command to a splice assembly to transition to a second roll of stock to replace the first roll of stock, and wherein the sensor is configured to communicate with a manual splice actuation system.

17. The sensor assembly of claim 16, wherein the manual splice actuation system is configured to initiate a splice in response to the command from the sensor to transition from the first roll to the second roll to provide a continuous web of stock.

18. The sensor assembly of claim 16, wherein the sensor is configured to communicate with the manual splice actuation system to bypass an automatic splice actuation system.

* * * * *